US008905397B2

(12) United States Patent
Le Gallo et al.

(10) Patent No.: US 8,905,397 B2
(45) Date of Patent: Dec. 9, 2014

(54) ARTICULATED MAIL SELECTOR

(71) Applicant: Neopost Technologies, Bagneux (FR)

(72) Inventors: Stéphane Le Gallo, Savigny sur Orge (FR); Dominique Bernard, Massy (FR)

(73) Assignee: Neopost Technologies, Bagneux (FR)

( * ) Notice: Subject to any disclaimer, the term of this patent is extended or adjusted under 35 U.S.C. 154(b) by 0 days.

(21) Appl. No.: 13/790,111

(22) Filed: Mar. 8, 2013

(65) Prior Publication Data

US 2014/0252714 A1 Sep. 11, 2014

(51) Int. Cl.
*B65H 3/04* (2006.01)
*G07B 17/00* (2006.01)

(52) U.S. Cl.
CPC ..... *G07B 17/00467* (2013.01)
USPC ..... 271/35

(58) Field of Classification Search
USPC ..... 271/3.05, 23, 35, 131, 136, 137, 138
See application file for complete search history.

(56) References Cited

U.S. PATENT DOCUMENTS

| | | | | |
|---|---|---|---|---|
| 5,238,236 | A * | 8/1993 | Belec et al. | 271/34 |
| 6,276,679 | B1 * | 8/2001 | Joyce et al. | 271/122 |
| 6,550,761 | B1 * | 4/2003 | Chiang | 271/104 |
| 6,971,645 | B2 * | 12/2005 | Coret et al. | 271/138 |
| 7,155,878 | B2 * | 1/2007 | Stemmle et al. | 53/381.5 |
| 7,392,979 | B2 * | 7/2008 | Sasaki et al. | 271/120 |
| 7,934,719 | B2 * | 5/2011 | Tratar | 271/35 |
| 8,235,380 | B2 * | 8/2012 | Claris | 271/131 |
| 8,485,518 | B2 * | 7/2013 | Sasaki | 271/121 |
| 2010/0176547 | A1 * | 7/2010 | Potter | 271/35 |
| 2010/0328737 | A1 * | 12/2010 | Shingai | 358/498 |
| 2011/0123307 | A1 | 5/2011 | Pillard | |

FOREIGN PATENT DOCUMENTS

| | | |
|---|---|---|
| EP | 2 325 120 A1 | 5/2011 |
| GB | 1 592 241 A | 7/1981 |
| WO | 03/042081 A2 | 5/2003 |

OTHER PUBLICATIONS

European Search Report of EP 12 30 5100 dated Jun. 29, 2012.

* cited by examiner

*Primary Examiner* — Jeremy R Severson
(74) *Attorney, Agent, or Firm* — Sughrue Mion, PLLC

(57) ABSTRACT

A selection module for separating envelopes one-by-one from a stack of envelopes and for transporting them downstream, wherein the selection module comprises a plurality of articulated guides co-operating with a plurality of selector rollers to select said envelopes one-by-one and to transport them downstream, the plurality of articulated guides comprising two parts (120, 122) connected one to the other by a first extremity (120*a*, 122*a*) crossed by a common pivot connection (16), the respective second extremities (120*b*, 122*b*) of the two parts articulated guide being adapted to pivot about first and second pivot axis (18, 22) in opposition to first and second resilient return means (20, 24) as the envelopes pass over the selector rollers, the second pivot axis being offset downstream relative to the first pivot axis and the second resilient return means forms an inclination angle of about 45° regarding horizontally.

7 Claims, 3 Drawing Sheets

ARTICULATED MAIL SELECTOR

FIELD OF THE INVENTION

The present invention relates to the field of mail handling and more particularly to an envelope selection device for a high-speed envelope feeder of a franking machine or "postage meter" that manages the selection of thin and thick envelopes in order to avoid paper jam and double feeding.

PRIOR ART

Introduction of mail in a franking machine is usually managed by a feeder adapted to receive various types of envelopes of greater or lesser thickness, typically lying in the range 0.1 to 16 mm. This feeder, typically a high-speed envelope feeder, is composed of a magazine, in which a stack of envelopes to frank is placed and of a selection module. The role of the magazine is to bring small packets of envelopes to the selection module which has to extract each envelope one by one while ensuring a predetermined gap between each envelope. This gap is very important. Indeed, if the gap is too small the franking machine located downstream the feeder will not be able to compute the imprint in time which causes the stop of the franking machine, whereas, if the gap is too big, the throughput of the franking machine will be slow down.

Moreover, in mix mail environment, it is hard to manage the selection of thin and thick envelopes. The efforts to apply on each envelope in order to separate thin envelopes from thick envelopes must be constant. If a too strong effort is applied to thick envelopes, there is a risk of paper jam and inversely if a too low effort is applied to thin envelopes double feeding will occur. This has for consequence an over-rated envelope (due to the double weight of the envelope) and a non-franked envelope (only one imprint is printed on the top envelope). In other word, the quality of the selection is very important for the global performance of the machine.

In previous applications, the applicant has proposed to add some flexible fingers over the path of the selection module to improve the envelope separation. Nevertheless, if a thick envelope arrives in the selection module, those fingers will apply a stronger effort than on a thin envelope. Indeed, at the beginning of a batch of envelopes to be processed the effort necessary to feed one envelope is much more important than the one needed at the end of the batch. Furthermore, the more the friction coefficient between two superimposed envelopes is important, harder it will be to separate the first bottom envelope from the stack.

OBJECT AND SUMMARY OF THE INVENTION

The present invention solves the above problems by providing a different arrangement of the selection module of the feeder able to ensure that a correct selection will be performed whatever are the size of the stack and the friction coefficient between envelopes.

To achieve this function, it is proposed a selection module for separating envelopes one-by-one from a stack of envelopes and for transporting them downstream, wherein said selection module comprises a plurality of articulated guides co-operating with a plurality of selector rollers to select said envelopes one-by-one and to transport them downstream, characterized in that each of said plurality of articulated guides comprises two parts connected one to the other by a first extremity crossed by a common pivot connection, the respective second extremities of said two parts of said articulated guide being adapted to pivot about first and second pivot axis in opposition to first and second resilient return means as the envelopes pass over the selector rollers, said second pivot axis being offset downstream relative to said first pivot axis and said second resilient return means forms an inclination angle of about 45° regarding horizontally.

The change of shape of the guide permitted by with this configuration in two articulated parts allows selecting thin and thick envelopes with a pressure of selection particularly adapted.

Advantageously, the lower part of the two parts articulated guide comprises a pad for increasing the friction effort on the envelope and the second extremity of the upper part of the two parts articulated guide pivots about the first pivot axis in opposition to an axial spring and, at a rest position, said upper part of the two parts articulated guide forms an inclination angle of about 50° regarding horizontally.

Advantageously, the second extremity of the lower part of the two parts articulated guide pivots about the second pivot axis in opposition to a compression spring and, at a rest position, said lower part of the two parts articulated guide forms an inclination angle of about 20° regarding horizontally.

Preferably, the selection module further comprises a flap located upstream said plurality of articulated guides and said common pivot connection comprises a stop forbidden the lower part of the two parts articulated guide to rotate in a counter clockwise direction from its rest position.

The invention also concerns a feeder for a franking machine including a selection module as previously described.

BRIEF DESCRIPTION OF THE DRAWINGS

The actual construction, operation and advantages of the present invention will be better understood by referring to the following drawings in which like numerals identify like parts.

DETAILED DESCRIPTION OF EMBODIMENTS

A high-speed envelope feeder conventionally has a feed zone formed essentially by a deck designed to receive a stack of envelopes and including first transport rollers for driving the envelopes downstream (and against a referencing wall) at a separation zone having a selection module in which the envelopes are extracted one by one from the stack of envelopes. Second transport rollers are, in general, provided at the outlet of said separation module for the purpose of conveying the envelopes extracted in this way downstream.

Figure 1:
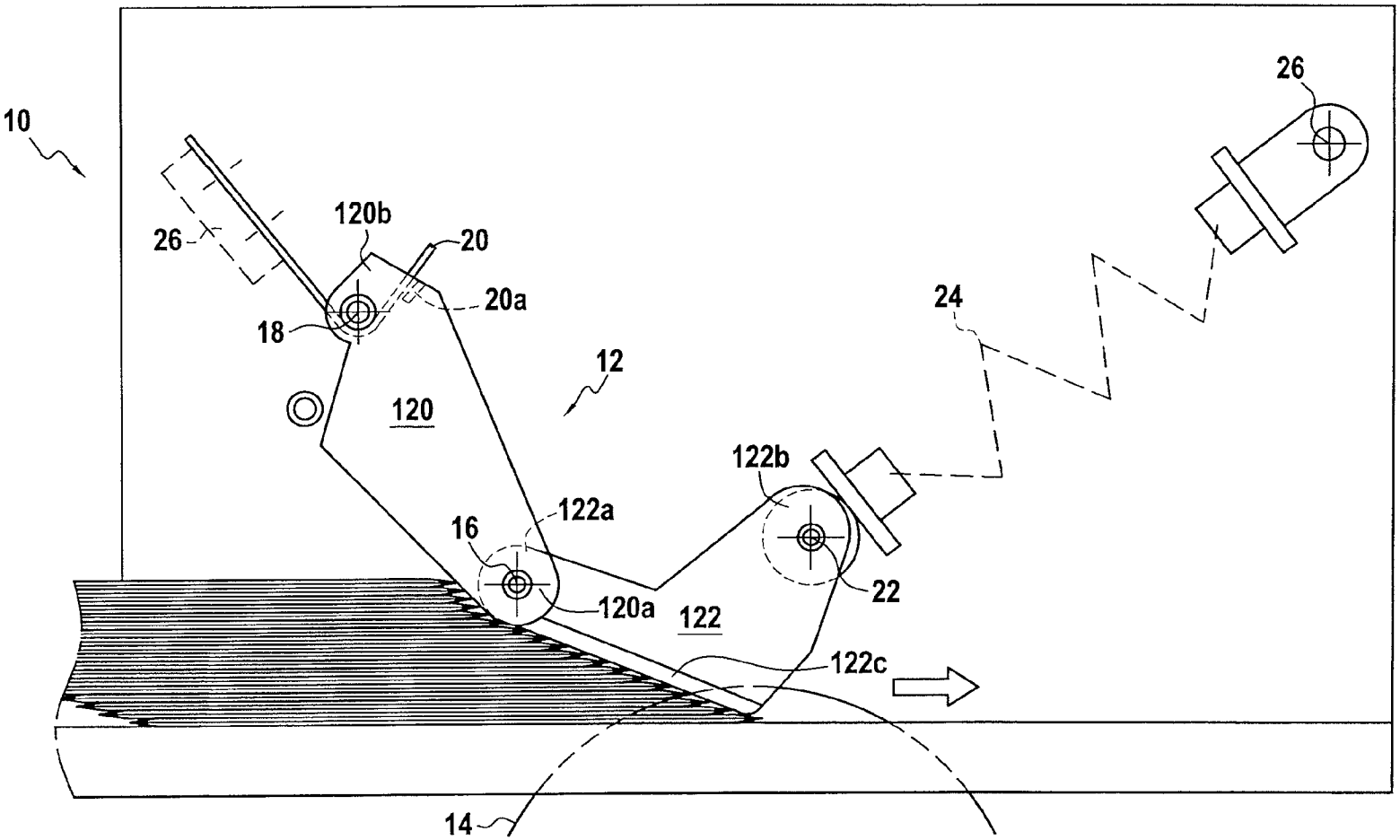
FIG. 1 shows a schematic view of a first embodiment of a selection module according to the invention.
Figure 2:
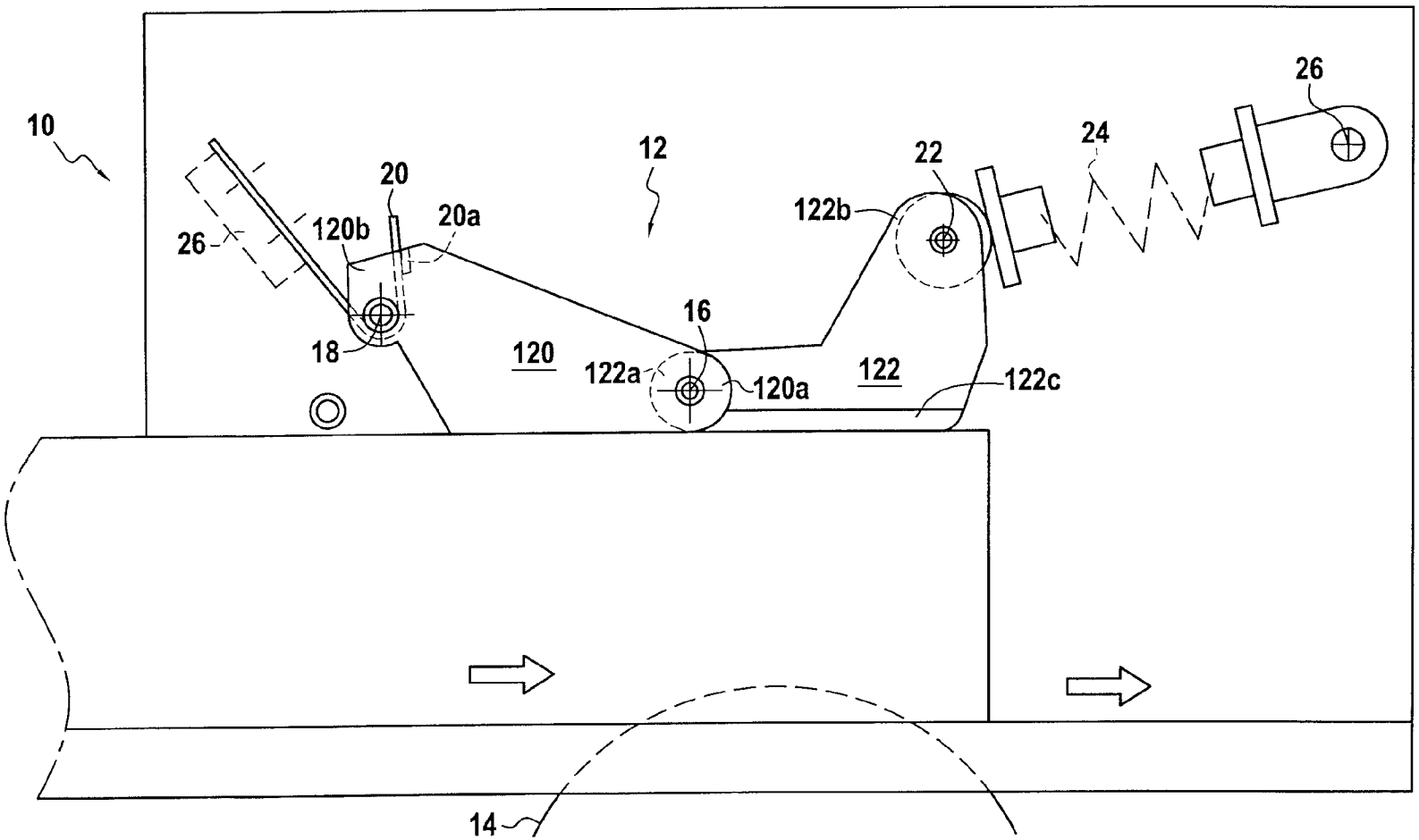
FIG. 2 shows at a position corresponding to an envelope of maximal thickness a schematic view of a selection module according to the invention.
Figure 3:
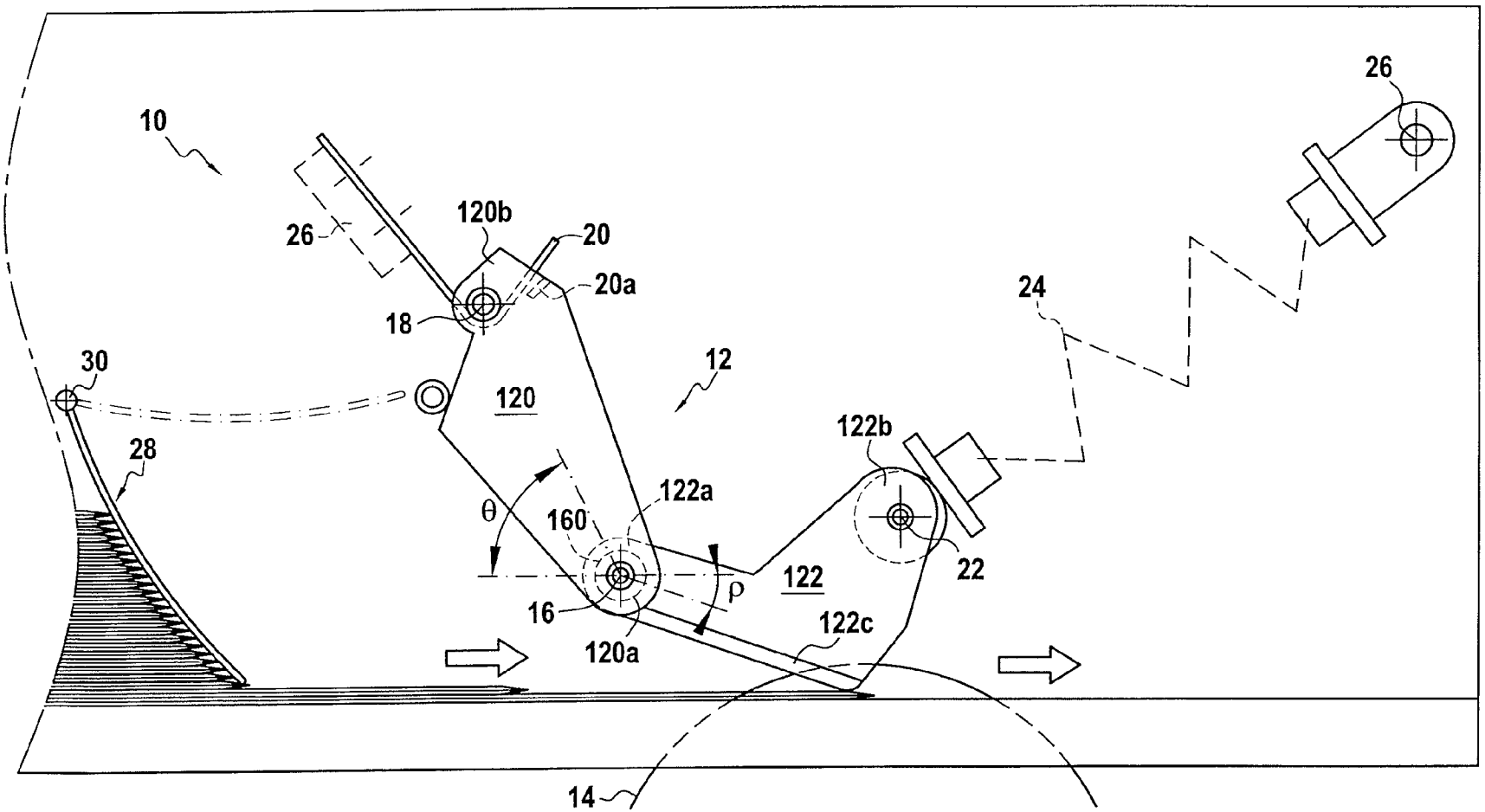
FIG. 3 shows a schematic view of a second embodiment of a selection module according to the invention.

More precisely, FIGS. 1 to 3 show a selection module 10 of the invention, which module essentially comprises a plurality of two parts articulated guides (or selection fingers 12) which co-operates with a plurality of selector rollers 14 to select a single envelope only and to transport it downstream. Each selection finger comprises upper and lower parts 120, 122 connected one to the other by a first extremity 120*a*, 122*a* crossed by a common pivot connection 16, a second extremity 120*b* of the upper part 120 of the selection finger being hinged about a first pivot axis 18, and can pivot in opposition to first resilient return means, e.g. axial spring 20, as the envelopes pass over the selector rollers and a second extremity 122*b* of the lower part 122 of the selection finger being hinged about a second pivot axis 22, and can pivot in opposition to second resilient return means, e.g. compression spring 24, as the envelopes pass over the selector rollers. The front surface of the lower part 122 of the selection finger comprises a pad 122*c* to increase the friction effort on the envelope.

The second pivot axis is offset downstream relative to the first pivot axis and the first resilient return means is classically in abutment against a stop 20*a* of the upper part and secondly a portion of framework 26 of the selection module about which they can pivot.

As illustrated in FIG. 3, the common pivot connection 16 can also be limited by a stop 160 that does not allow (from its rest position) the lower part 122 of the selection finger to rotate in the counter clockwise direction. In this embodiment, for better shingling the pile of envelopes a flap 28 hinged about an axis 30 is placed before the separation zone upstream the plurality of articulated guides.

Each selection finger is not disposed perpendicularly to the transport path of the envelopes, but rather it is inclined downstream as shown, by an inclination angle θ of about 50° for its upper part 120 and an inclination angle ρ of about 20° for its lower part 122. So, the whole finger is not closely in alignment (at 180°) but presents an inclination angle between its two parts of about 150° defining two zones of selection, one for singling thin envelopes (less than 6 mm corresponding sensibly to the height of the pivot connection 16 vis-à-vis the reference deck) and the other for singling thick envelopes (from 6 to 16 mm corresponding to the maximal height position of FIG. 3) or for retain the rest of the envelope pile to be selected and increase the pressure in the singling zone. The two parts articulated guide is advantageously like a comb-shaped selector, with each of the selection fingers of the comb being disposed between two adjacent selector rollers.

The selection module of the invention operates as follows. When a thick (between 6 to 20 mm) pile of envelopes approaches, it begins to enter into contact with the upper part 120 of the selection fingers which rotate around the first pivot axis 18 against the axial spring 20 (see for example FIG. 1). When the upper part 120 rotates about the first pivot axis 18 (θ decreases), the lower part 122 moves to the right and thus increase the vertical component of the effort applied to it. Indeed, three phenomena are combined, the spring force of the compression spring 24 increases, the lever arm of the application of the spring force to the pivot connection 16 is increased and the angle of the said force approaches the verticality. The pressure of the pile of envelopes against the upper part 120 depend on the weight of the pile and of the friction coefficient between envelopes; the displacement of the upper part 120 will be a function of these two parameters and thus the variation of the vertical force on the pad 122*c* will also be a function of these two said parameters.

The more the weight of the stack will be important and/or the more the friction between envelopes will be high, the greater the pressure on the upper part 120 of the selection fingers will be important, and the change of shape will be important. Note that most the deformation is, the greater the effort is. This is notably due to the inclination at about 45° regarding horizontally of the compression spring 24 which is not vertical (i.e. at 90°) as usual in selection systems of the art.

Then the envelope arrives in contact with the pad 122*c* of lower part 122 of the selection fingers if the pressure exerted by the pile of envelope on the upper part 120 of the selection finger is important (ie. envelopes are difficult to separate), the force exerted by the compression spring 24 via the lower part 122 of the selection fingers is maximal on its bottom (close to the reference deck) which facilitate the separation of envelopes.

When a thick envelope approaches, it begins to enter into contact with the upper part 120 of the selection fingers which rotate around the first pivot axis 18 against the axial spring 20 (see for example FIG. 2). Due to this rotation of the upper part 120 of the selection fingers the axial spring force increases. One can note that, as the upper part 120 of the selection finger has no pad (as the pad 122*c* of the lower part 122 of the finger), the friction effort is quite low on the envelope. At this stage, the envelope sustained pressure exerted by the axial spring 20 through the upper part 120 of the selection fingers but does not support any friction effort.

The general shape of the whole selection fingers has changed such that the orientation of the compression spring 24 is changed to decrease the force of selection on the lower part 122 of the selection fingers. Then the envelope arrives in contact with the lower part 122 of the selection fingers on the top (near the common pivot connection 16) which reduces the pressure exerted by the compression spring 24. Indeed, the force exerted by the compression spring via the lower part 122 of the selection fingers is maximal on its bottom (close to the reference deck).

When the selection module of the invention is equipped with the stop 160, the pile of envelopes must be shingled by the flap 28 when it reaches the separation zone.

Once shingled, the pressure exerted by the pile of envelope on the upper part 120 is strongly reduced and thus, the whole selection finger is not deformed. Thus, when a thin envelope get in front of the selection fingers, the lower part 122 of the selection fingers press the envelope with the force exerted by the compression spring 24. However, as the common pivot connection 16 comprises the stop 160, it is not only the lower part but the whole fingers (120+122) which rotate around the first pivot axis 18. As the whole fingers pivot around the first pivot axis 18 the force exerted by the axial spring 20 and the one exerted by the compression spring 24 are combined, the resulting pressure on the envelope through the lower part 122 of the selection fingers (close to the reference deck) is greater than if only the force of the compression spring 24 had been implemented (even when the shape of the finger as changed in order to increase the effort applied by the pad 122*c*).

In this configuration (with the stop 160) the operation of thick envelop selection is the same than in the configuration without the stop 160.

With an appropriate calibration of the springs 20 and 24, the configuration with a stop ensures an almost constant effort of selection regardless of the thickness of the envelope comparing with a configuration without such stop. Indeed, the effort required by a thick envelope to push both part of the finger will be quite important (ie. proportional to the important compression of the spring 20 required to push the upper part 120 of the selection fingers). So to obtain an equivalent selection effort on a thin envelope (which not require an important compression of the spring 24), the combination of the pressing effort of both spring 20 and 24 is necessary.

The invention claimed is:

1. A selection module for separating envelopes one-by-one from a stack of envelopes and for transporting them downstream, wherein said selection module comprises:

a plurality of selector rollers; and a plurality of articulated guides co-operating with said plurality of selector rollers to select said envelopes one-by-one and to transport them downstream along a horizontal transport path, wherein each of said plurality of articulated guides comprises lower and upper parts (120, 122) connected one to the other by a first extremity (120*a*, 122*a*) crossed by a common pivot connection (16), the respective second extremities (120*b*, 122*b*) of said lower and upper parts of said articulated guide being adapted to pivot about first and second pivot axis (18, 22) in opposition to first and second resilient return means (20, 24) as the envelopes pass over the selector rollers, wherein said second pivot axis is offset downstream relative to said first pivot axis and said second resilient return means forms at a rest position an inclination angle of about 45° relative to the horizontal transport path and wherein the lower part (122) of the articulated guide comprises a pad (122*c*) for increasing the friction effort on the envelope.

2. A selection module according to claim 1, characterized in that the second extremity (120*b*) of the upper part (120) of the articulated guide pivot about the first pivot axis (18) in opposition to an axial spring (20).

3. A selection module according to claim 2, characterized in that at a rest position, said upper part of the articulated guide forms an inclination angle of about 45° regarding horizontally.

4. A selection module according to claim 1, characterized in that the second extremity (122*b*) of the lower part (122) of the articulated guide pivot about the second pivot axis (22) in opposition to a compression spring (24).

5. A selection module according to claim 4, characterized in that at a rest position, said lower part of the articulated guide forms an inclination angle of about 30° regarding horizontally.

6. A selection module according to claim 1, characterized in that it further comprises a flap (28) located upstream said plurality of articulated guides and said common pivot connection comprises a stop (160) forbidden the lower part of the articulated guide to rotate in a counter clockwise direction from its rest position.

7. A feeder for a franking machine including a selection module according to claim 1.

* * * * *